US006213299B1

(12) United States Patent
Rossi

(10) Patent No.: US 6,213,299 B1
(45) Date of Patent: Apr. 10, 2001

(54) COOLANT CAP COLOR CODING SYSTEM

(76) Inventor: Brian L. Rossi, 7496 Kingswood Dr., West Chester, OH (US) 45069

( * ) Notice: Subject to any disclaimer, the term of this patent is extended or adjusted under 35 U.S.C. 154(b) by 0 days.

(21) Appl. No.: 09/428,882

(22) Filed: Oct. 28, 1999

(51) Int. Cl.[7] ..... B65D 85/68
(52) U.S. Cl. ..... 206/459.5; 206/335; 215/230
(58) Field of Search ..... 206/335, 459.5, 206/459.1; 215/228, 230; 220/837; 40/310; 359/440, 656, 809; 116/200, 201; 165/11.1; 184/88.1, 88.2, 90, 109

(56) References Cited

U.S. PATENT DOCUMENTS 4,753,358 * 6/1988 Virca et al. ..... 215/230
5,289,919 * 3/1994 Fischer ..... 206/459.5
5,385,252 * 1/1995 Hidding et al. ..... 215/230
5,730,292 * 3/1998 Jones ..... 206/459.5
5,743,407 * 4/1998 Williams ..... 206/459.5
5,941,394 * 8/1999 Siegler ..... 206/459.5
6,036,017 * 3/2000 Bayliss, IV ..... 206/459.5

* cited by examiner

*Primary Examiner*—Luan K. Bui

(57) ABSTRACT

A coolant cap color coding system for providing a coolant container cap having a visual indicator corresponding to a type of coolant required by a vehicle. The coolant cap color coding system includes a coolant container cap having a colored indicator corresponding to a specific required coolant type. The coolant cap is provided for coupling to an existing coolant container cap or for replacing the existing coolant container cap.

7 Claims, 4 Drawing Sheets

FIG 1
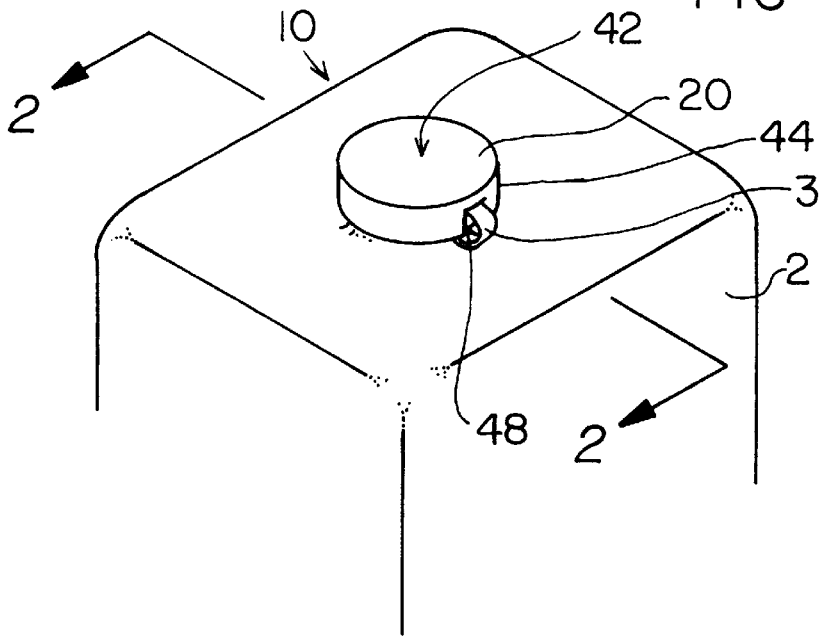
FIG 2
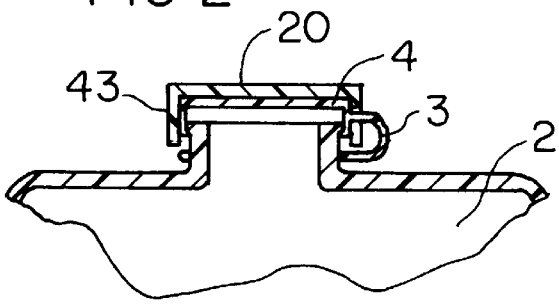
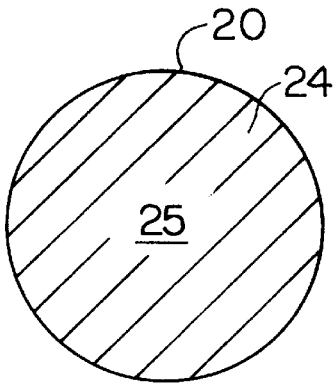
FIG 3
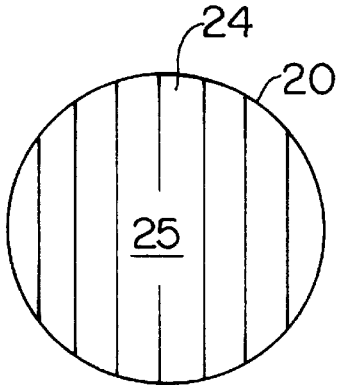
FIG 4
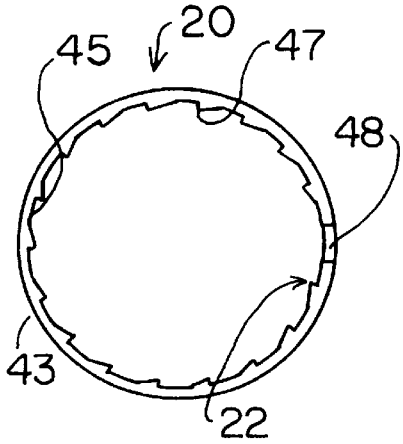
FIG 5

COOLANT CAP COLOR CODING SYSTEM

BACKGROUND OF THE INVENTION

1. Field of the Invention

The present invention relates to color coding systems and more particularly pertains to a new coolant cap color coding system for providing a coolant container cap having a visual indicator corresponding to a type of coolant required by a vehicle.

2. Description of the Prior Art

The use of color coding systems is known in the prior art. More specifically, color coding systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,529,417; 4,143,786; U.S. Pat. No. Des. 394,184; U.S. Pat. Nos. 4,649,747; 5,678,729; and 5,283,061.

While these devices fulfill their respective, particular objectives and requirements, the aforementioned patents do not disclose a new coolant cap color coding system. The inventive device includes a coolant container cap having a colored indicator corresponding to a specific required coolant type. The coolant cap is provided for coupling to an existing coolant container cap or for replacing the existing coolant container cap.

In these respects, the coolant cap color coding system according to the present invention substantially departs from the conventional concepts and designs of the prior art, and in so doing provides an apparatus primarily developed for the purpose of providing a coolant container cap having a visual indicator corresponding to a type of coolant required by a vehicle.

SUMMARY OF THE INVENTION

In view of the foregoing disadvantages inherent in the known types of color coding systems now present in the prior art, the present invention provides a new coolant cap color coding system construction wherein the same can be utilized for providing a coolant container cap having a visual indicator corresponding to a type of coolant required by a vehicle.

The general purpose of the present invention, which will be described subsequently in greater detail, is to provide a new coolant cap color coding system apparatus and method which has many of the advantages of the color coding systems mentioned heretofore and many novel features that result in a new coolant cap color coding system which is not anticipated, rendered obvious, suggested, or even implied by any of the prior art color coding systems, either alone or in any combination thereof.

To attain this, the present invention generally comprises a coolant container cap having a colored indicator corresponding to a specific required coolant type. The coolant cap is provided for coupling to an existing coolant container cap or for replacing the existing coolant container cap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new coolant cap color coding system apparatus and method which has many of the advantages of the color coding systems mentioned heretofore and many novel features that result in a new coolant cap color coding system which is not anticipated, rendered obvious, suggested, or even implied by any of the prior art color coding systems, either alone or in any combination thereof.

It is another object of the present invention to provide a new coolant cap color coding system that may be easily and efficiently manufactured and marketed.

It is a further object of the present invention to provide a new coolant cap color coding system that is of a durable and reliable construction.

An even further object of the present invention is to provide a new coolant cap color coding system which is susceptible of a low cost of manufacture with regard to both materials and labor, and which accordingly is then susceptible of low prices of sale to the consuming public, thereby making such coolant cap color coding system economically available to the buying public.

Still yet another object of the present invention is to provide a new coolant cap color coding system which provides in the apparatuses and methods of the prior art some of the advantages whereof, while simultaneously overcoming some of the disadvantages normally associated therewith.

Still another object of the present invention is to provide a new coolant cap color coding system for providing a coolant container cap having a visual indicator corresponding to a type of coolant required by a vehicle.

Yet another object of the present invention is to provide a new coolant cap color coding system which includes a coolant container cap having a colored indicator corresponding to a specific required coolant type. The coolant cap is provided for coupling to an existing coolant container cap or for replacing the existing coolant container cap.

Still yet another object of the present invention is to provide a new coolant cap color coding system that provides a coolant cap having structure for facilitating gripping of the coolant cap.

Even still another object of the present invention is to provide a new coolant cap color coding system that facilitates identification of the proper coolant to prevent introduction of potentially harmful ingredients from an improper type of coolant into a coolant system of a vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new coolant cap color coding system according to the present invention.

FIG. 2 is a cross-sectional view of the present invention taken along line 2—2 of FIG. 1.

FIG. 3 is a top view of the present invention showing green coloring of the invention.

FIG. 4 is a top view of the present invention showing red coloring of the invention.

FIG. 5 is a bottom view of the present invention.

DESCRIPTION OF THE PREFERRED EMBODIMENT

Figure 7:
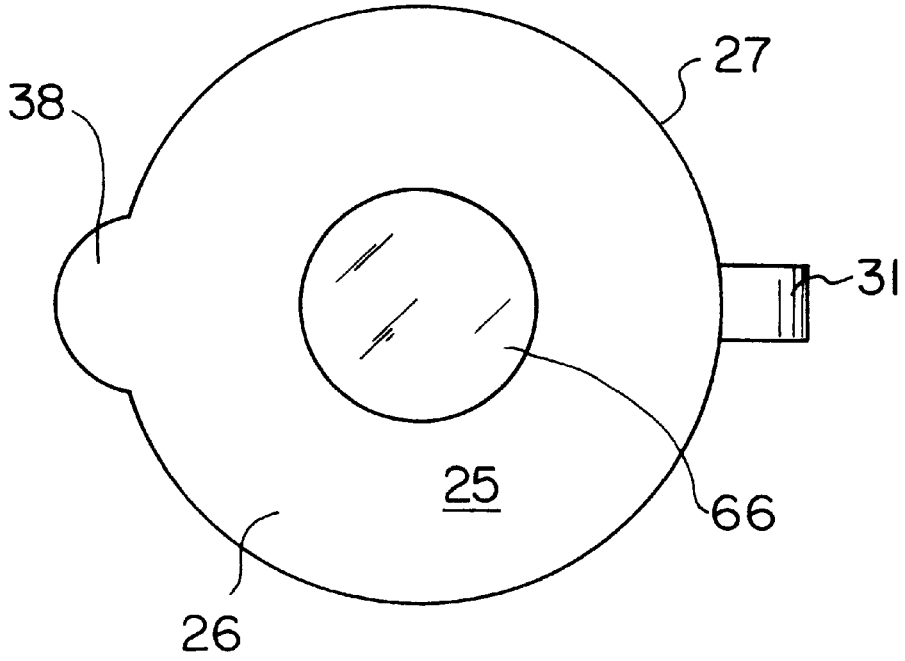
FIG. 7 is a top view of the embodiment of the present invention.

With reference now to the drawings, and in particular to FIGS. 1 through 10 thereof, a new coolant cap color coding system embodying the principles and concepts of the present invention and generally designated by the reference numeral 10 will be described.

As best illustrated in FIGS. 1 through 10, the coolant cap color coding system 10 generally comprises a plurality of coolant types, each coolant type includes a distinctive formula of ingredients. Each coolant type includes an associated distinct color with respect to each other coolant type for facilitating visual identification of each coolant type.

A coolant cap 20 includes a connection portion 22 designed for coupling to a coolant container 2 of the coolant system of a vehicle. The coolant cap includes a colored portion 24 having a single color corresponding to the associated distinct color of one of the plurality of coolant types corresponding to a required coolant type for the vehicle. Thus, the coolant cap provides a visual indication of the proper coolant for the vehicle.

The coolant cap includes a top 26, an annular bottom portion 28, and a perimeter wall 29 that extends substantially orthogonally from a perimeter edge 27 of the top for selectively engaging the bottom portion. The top is coupled to the bottom portion by a flexible connector 31 for preventing the top from fully uncoupling from the bottom portion.

Figure 6:
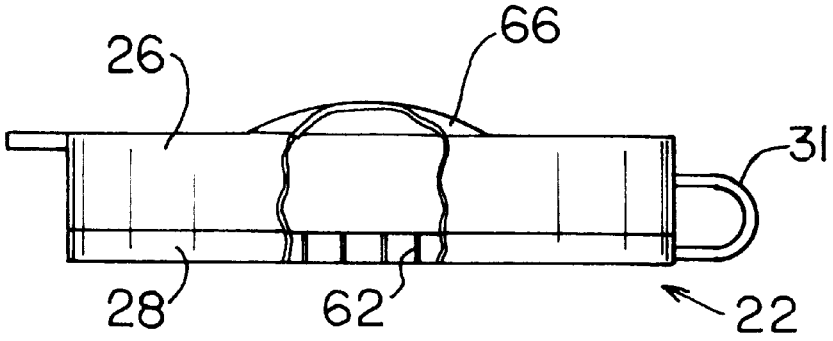
FIG. 6 is a partial cut-away side view of an embodiment of the present invention.
Figure 8:
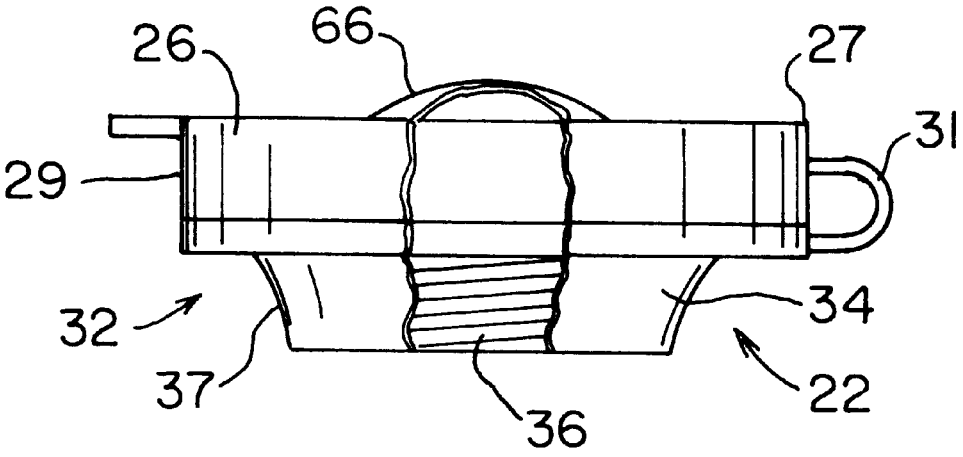
FIG. 8 is a partial cut away side view of another embodiment of the invention.
Figure 10:
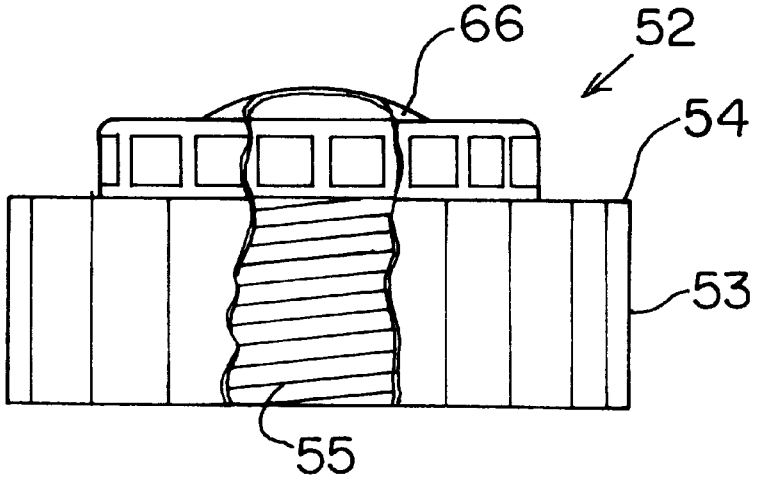
FIG. 10 is a partial cut away side view of the present invention.
Figure 9:
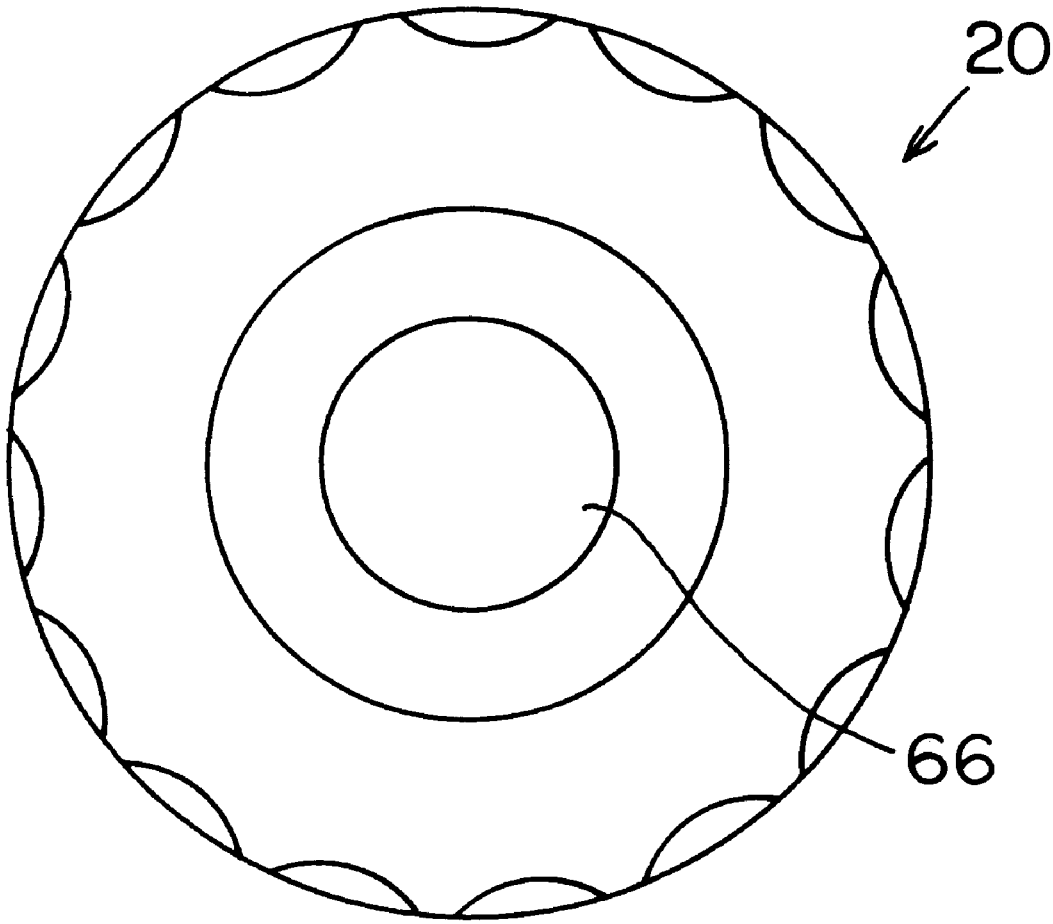
FIG. 9 is a top view of an embodiment of the present invention.

As seen in FIGS. 3 and 4, the entire coolant cap may be colored or alternately, the colored portion can be a transparent dome lens 66 that extends from a central position of a top surface 25 of the coolant cap, as seen in FIGS. 6, 7, and 8.

In one embodiment, the connection portion is defined by the bottom portion having an upper rim 32 and an annular connection wall 34 that extends downwardly from the upper rim. The connection wall includes a threaded inwardly facing surface 36 such that the connection wall is designed for engaging existing complimentary threading of the coolant container. Thus, the coolant cap is designed for engaging the coolant container.

In another embodiment, the bottom portion includes a plurality of inwardly facing gripping teeth 62 for coupling the bottom portion directly to the coolant container.

The coolant cap also includes a lip portion 38 that extends outwardly from the perimeter wall of the top for facilitating selective disengagement of the top from the upper rim of the bottom portion. Thus, the coolant cap is designed for selective opening for facilitating adding coolant to the coolant container while the bottom portion is engaged to the coolant container.

The upper rim of the bottom portion includes a diameter greater than a diameter of the connection wall for facilitating gripping of the coolant cap by a user for engaging and disengaging the bottom portion of the coolant cap from the coolant container. In an embodiment, an outer surface 37 of the connection wall is curved to facilitate comfortable gripping of the coolant cap.

In an alternate embodiment, the coolant cap includes a top 42 and a perimeter wall 43 that extends substantially orthogonally from a perimeter edge 44 of the top 42, the perimeter wall includes an inwardly facing surface 45. The connection portion includes a plurality of gripping teeth 47 that extend from the inwardly facing surface 45 of the perimeter wall 43. The gripping teeth are designed for engaging an existing lid 4 of the coolant container. The coolant cap further includes a cutout 48 in the perimeter wall designed for receiving a connection member 3 therein for facilitating engagement of the coolant cap to the existing lid.

In another embodiment of the invention, the coolant cap includes a top 52 and a perimeter wall 53 that extends substantially orthogonally from a perimeter edge 54 of the top 52. The perimeter wall 53 includes an inwardly facing surface 55 that is threaded such that the coolant cap is designed for engaging existing complimentary threading of the coolant container whereby the coolant cap is designed for engaging the coolant container.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A color coding system for facilitating identification of a required type of coolant for addition into a coolant system of a vehicle, the color coding system comprising:

a plurality of coolant types, each coolant type having a distinctive formula of ingredients, each coolant type having an associated distinct color with respect to each other coolant type for facilitating visual identification of each coolant type;

a coolant cap having a connection portion, said connection portion being adapted for coupling to a coolant container of the coolant system of the vehicle;

said coolant cap having a colored portion, said colored portion being a single color corresponding to said associated distinct color of one of said plurality of coolant types corresponding to a required coolant type for the vehicle;

said coolant cap having a top, a bottom portion and a perimeter wall extending substantially orthogonally from a perimeter edge of said top for selectively engaging said bottom portion; and said bottom portion having an upper rim and an annular connection wall extending downwardly from said upper rim, said connection wall having a threaded inwardly facing surface such that said connection wall is adapted for engaging existing complimentary threading of the coolant container whereby said coolant cap is adapted for engaging said coolant container.

2. The color coding system of claim 1, further comprising:

said coolant cap having a top and a perimeter wall extending substantially orthogonally from a perimeter edge of said top, said perimeter wall having an inwardly facing surface; and said inwardly facing surface of said perimeter wall being threaded such that said coolant cap is adapted for engaging existing complimentary threading of the coolant container whereby said coolant cap is adapted for engaging said coolant container.

3. The color coding system of claim 1, further comprising:

said colored portion being located on a top surface of said coolant cap.

4. The color coding system of claim 1, further comprising:

said colored portion being a transparent dome lens extending from a top surface of said coolant cap.

5. The color coding system of claim 1, further comprising:

said upper rim of said bottom portion having a diameter greater than a diameter of said connection wall for facilitating gripping of the coolant cap by a user.

6. A color coding system for facilitating identification of a required type of coolant for addition into a coolant system of a vehicle, the color coding system comprising:

a plurality of coolant types, each coolant type having a distinctive formula of ingredients, each coolant type having an associated distinct color with respect to each other coolant type for facilitating visual identification of each coolant type;

a coolant cap having a connection portion, said connection portion being adapted for coupling to a coolant container of the coolant system of the vehicle;

said coolant cap having a colored portion, said colored portion being a single color corresponding to said associated distinct color of one of said plurality of coolant types corresponding to a required coolant type for the vehicle;

said coolant cap having a top, an annular bottom portion, and a perimeter wall extending substantially orthogonally from a perimeter edge of said top for selectively engaging said bottom portion, said top being coupled to said bottom portion by a flexible connector for preventing said top from fully uncoupling from said bottom portion;

said colored portion being a transparent dome lens extending from a central position of a top surface of said coolant cap;

said connection portion comprising said bottom portion having an upper rim and an annular connection wall extending downwardly from said upper rim, said connection wall having a threaded inwardly facing surface such that said connection wall is adapted for engaging existing complimentary threading of the coolant container whereby said coolant cap is adapted for engaging said coolant container;

said coolant cap having a lip portion extending outwardly from said perimeter wall of said top for facilitating selective disengagement of said top portion from said upper rim of said bottom portion whereby said coolant cap is adapted for selective opening for facilitating adding coolant to the coolant container while the bottom portion is engaged to the coolant container; and said upper rim of said bottom portion having a diameter greater than a diameter of said connection wall for facilitating gripping of the coolant cap by a user for engaging and disengaging said bottom portion of said coolant cap from the coolant container.

7. A color coding system for facilitating identification of a required type of coolant for addition into a coolant system of a vehicle, the color coding system comprising:

a plurality of coolant types, each coolant type having a distinctive formula of ingredients, each coolant type having an associated distinct color with respect to each other coolant type for facilitating visual identification of each coolant type;

a coolant cap having a connection portion, said connection portion being adapted for coupling to a coolant container of the coolant system of the vehicle;

said coolant cap having a colored portion, said colored portion being a single color corresponding to said associated distinct color of one of said plurality of coolant types corresponding to a required coolant type for the vehicle;

said coolant cap having a top, a bottom portion and a perimeter wall extending from said top for selectively engaging said bottom portion; and said bottom portion having an upper rim and a connection wall extending downwardly from said upper rim, said connection wall having a threaded surface such that said connection wall is adapted for engaging a threaded surface of the coolant container such that said coolant cap is adapted for being removably mounted on the coolant container.

* * * * *